US006009935A

United States Patent [19]

Shiret

[11] Patent Number: 6,009,935

[45] Date of Patent: Jan. 4, 2000

[54] RADIATORS

[75] Inventor: Alan Reginald Shiret, Nottingham, United Kingdom

[73] Assignee: BG plc, Reading, United Kingdom

[21] Appl. No.: 08/855,951

[22] Filed: May 14, 1997

[30] Foreign Application Priority Data

May 15, 1996 [GB] United Kingdom ..... 96 10139

[51] Int. Cl.[7] ..... F28D 15/00

[52] U.S. Cl. ..... 165/104.21; 165/104.14; 392/377; 392/378

[58] Field of Search ..... 165/104.19, 104.21, 165/104.26, 168, 104.14; 392/377, 378

[56] References Cited

U.S. PATENT DOCUMENTS

| | | | |
|---|---|---|---|
| 2,359,774 | 10/1944 | Mcintosh | 392/377 |
| 2,455,688 | 12/1948 | Malickson | 392/377 |
| 4,129,181 | 12/1978 | Janowski et al. | 165/133 |
| 4,503,906 | 3/1985 | Andres et al. | 165/104.14 |
| 4,567,351 | 1/1986 | Kitagawa et al. | 165/146 |
| 4,787,441 | 11/1988 | Granryd et al. | 165/104.26 |
| 4,909,316 | 3/1990 | Kamei et al. | 165/104.26 |
| 5,076,350 | 12/1991 | Grantz et al. | 165/104.21 |
| 5,156,208 | 10/1992 | Masuki et al. | 165/104.26 |

FOREIGN PATENT DOCUMENTS

| | | | |
|---|---|---|---|
| 631175 | 10/1949 | European Pat. Off. | 165/104.19 |
| 0177660 | 11/1984 | European Pat. Off. | 165/104.19 |
| 2730-541 | 1/1978 | Germany | 165/104.21 |
| 2820-918 | 12/1978 | Germany | 165/104.21 |
| 52-74949 | 6/1977 | Japan | 165/181 |
| 54-160298 | 12/1980 | Japan | 165/104.14 |
| 54-98296 | 3/1981 | Japan | 165/104.21 |
| 55-33134 | 10/1981 | Japan | 165/104.21 |
| 63-209302 | 2/1990 | Japan | 165/104.21 |
| 1064379 | 4/1967 | United Kingdom | 165/104.21 |
| 1284506 | 12/1968 | United Kingdom | 165/104.33 |
| 1 488 482 | 10/1977 | United Kingdom | 165/104.19 |
| 2 099 980 | 12/1982 | United Kingdom | 165/104.19 |

*Primary Examiner*—Ira S. Lazarus
*Assistant Examiner*—Terrell McKinnon
*Attorney, Agent, or Firm*—Oblon, Spivak, McClelland, Maier & Neustadt, P.C.

[57] ABSTRACT

A thermosyphon radiator comprising a sealed panel is formed into two or more discrete chambers, each containing a reservoir of vaporising liquid in a lowermost part of the panel and a heating member extending with clearance through the lowermost part of the panel, the member being at least partially immersed in the vaporising liquid.

14 Claims, 1 Drawing Sheet

RADIATORS

BACKGROUND OF THE INVENTION

1. Field of the Invention

This invention relates to thermosyphon radiators.

2. Description of the Related Art

Thermosyphon radiators are of the type in which a vaporising liquid contained within a sealed panel is heated, in use, by a heating pipe passing through the vaporising liquid.

A radiator which operates on the thermosyphon principle is described in GB published patent application Ser. No. 2286881.

This type of radiator provides advantages of speed of response, even temperature and isolation of the heating system water from the main body of the radiator.

One problem with this type of radiator is that a single sealed panel when operated under vacuum conditions, will operate at uniform pressure and therefore the chamber will also operate at uniform temperature. This means that the radiator chamber temperature cannot exceed the radiator system water outlet temperature and consequently the heat output of the radiator is limited compared with a conventional panel radiator. For example a conventional radiator would have a mean surface temperature of approximately 70° C. if the heating pipe inlet and exit water temperatures were 80° C. and 60° C. respectively. With a thermosyphon radiator, the mean surface temperature is limited to less than the return water temperature, i.e. 60° C. which has the effect of reducing the heat output of the radiator significantly.

BRIEF SUMMARY OF THE INVENTION

It is therefore an object of the present invention to provide a thermosyphon radiator which increases the effective heat output of the radiator for a given overall size and can more closely achieve the heat output of a conventional radiator.

The invention described here provides improved performance compared with standard thermosyphon radiator. The original radiator operates with a single chamber which is evacuated and allows the vaporising liquid to boil off once heat is applied to the heating pipe. The performance of this radiator is restricted to the pressure which corresponds to the lowest temperature in the system. In a single chamber design, the vacuum pressure is equal within the compartment and the temperature is therefore also uniform and maintained at a level corresponding to the minimum temperature in the heating pipe.

According to one aspect of the present invention, we provide a thermosyphon radiator comprising a sealed panel formed into two or more discrete chambers, each containing a reservoir of vaporising liquid in a lowermost part of the panel and a heating member extending with clearance through the lowermost part of the panel, the member being at least partially immersed in the vaporising liquid.

The vaporising liquid may be water, but ammonia, methanol or acetone are viable alternatives.

According to another aspect of the present invention we provide a thermosyphon radiator comprising a sealed panel formed into two or more discrete chambers, each containing water in a lowermost part of the panel and a heating member extending with clearance through the lowermost part of the panel.

Preferably the member is a pipe for carrying a second liquid. Suitably the pipe is covered externally with a fine metallic mesh, compacted metallic wool, fibrous material or a polymeric coating. Alternatively the pipe can be coated with a porous material such as a sintered metallic or ceramic material.

Conveniently the pipe is immersed in the vaporising fluid, e.g. water to a depth of no less than three-quarters of the diameter of the pipe.

The panel may be of press steel or roll-bonded aluminium, which may be pre-treated to inhibit corrosion.

Each reservoir may be hermetically sealed and preferably each chamber is evacuated except for the vaporising liquid.

The radiator may be externally finned to increase the heat transfer to the space to be heated.

Suitably the water is distilled water and may contain corrosion inhibitors.

This invention uses two or more chambers which are arranged in series with the heating pipe. In this case the two (or more) chambers will operate at pressures corresponding to the minimum temperatures in each chamber. As the heating pipe passes in series from chamber A to B, the minimum temperature of water in compartment A will be higher than compartment B.

Taking the example shown in FIG. 1, if the inlet and exit temperatures to chamber A are 80° C. and 70° C. respectively, the vacuum pressure in compartment A will correspond to 70° C. Then the inlet and exit temperatures to compartment B could be 70° C. and 60° C. and therefore the vacuum pressure to compartment B will correspond to 60° C. In a single chamber design operating with inlet and exit temperatures of 80° C. and 60° C., the vacuum pressure will correspond to 60° C. Therefore a single chamber radiator will have a surface temperature of approximately 60° C. and a radiator with two chambers would have a surface temperature of approximately 65° C. (i.e. half of the radiator is at 60° C. and the other half at 70° C.).

Since the heat output of the radiator depends on its surface temperature, a multi-chamber radiator will provide higher heat output than an equivalent size single chamber radiator.

BRIEF DESCRIPTION OF THE SEVERAL VIEWS OF THE DRAWINGS

An embodiment of the invention will now be described by way of example only with reference to the accompanying drawings in which.

DETAILED DESCRIPTION OF THE INVENTION

Figure 1:
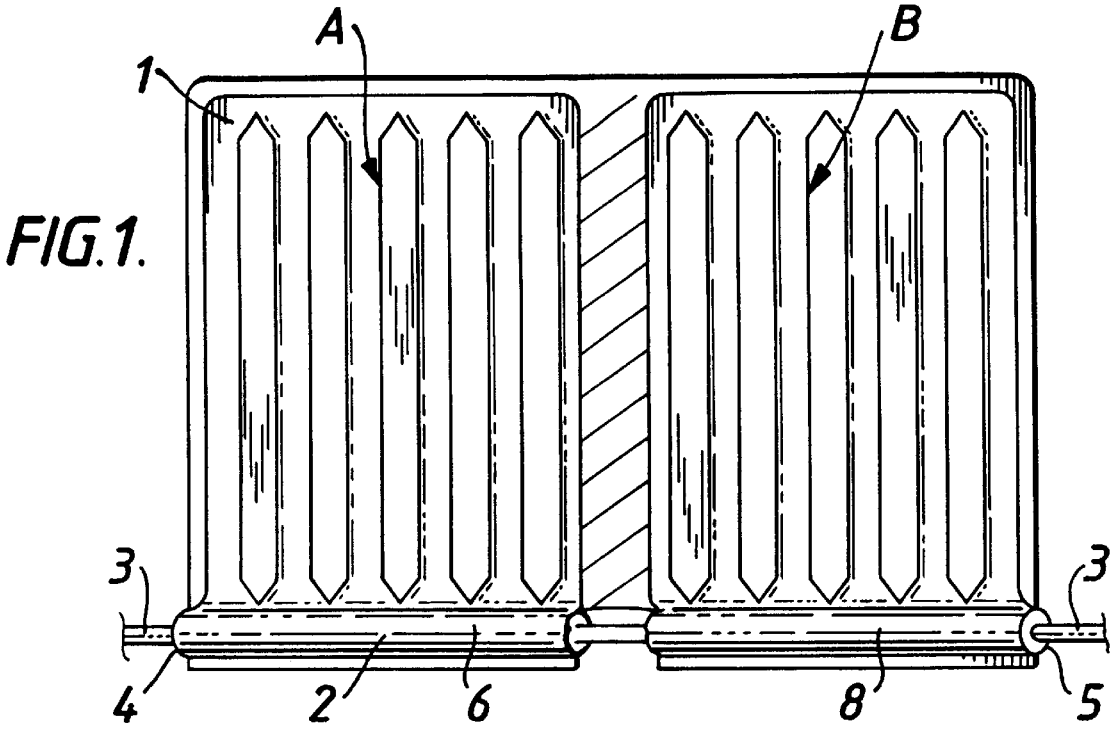
FIG. 1 is a perspective view of the radiator.

Referring to the drawings, the radiator comprises a conventional sealed panel having a lowermost part 2 through which a pipe 3 enters at one side 4 and leaves by the other side 5. The pipe 3 may be a hot water pipe supplied with hot water from a boiler (not shown) and is joined to the panel 1. The panel 1 is divided into two (or more—not shown) and hermetically sealed and evacuated except for the vaporising liquid.

Figure 2:
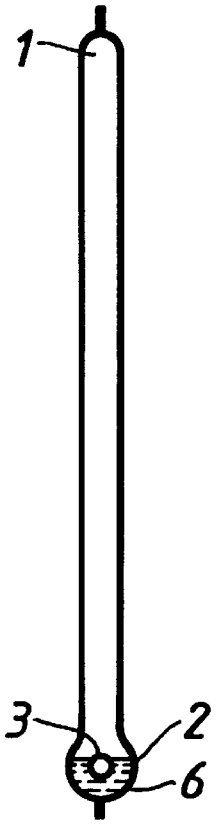
FIG. 2 is a cross sectional view of the radiator.

The lowermost part 2 of the panel which is also divided into two (or more) reservoirs, 6 and 8, corresponding to chambers A and B and each contain a reservoir of water (FIG. 2) and the pipe 3, which extends with clearance through the internal panel sides formed by the lowermost part 2 in both chambers A and B. Chambers A and B (and C, D, etc.) are filled with vaporising liquid and then sealed for life using pre-formed connection points.

When hot water, from a boiler for example, passes through the pipe 3, the water begins to boil extracting latent heat from the pipe 3 and the vapour so produced rises to the upper part of the radiator panel in both chambers A and B where it condenses on the inside surface to give out its latent heat to the panel surfaces and therefore to the space to be heated. The condensate then trickles back down to the reservoirs 6 and 8. The action of boiling and condensation in each chamber A and B are separate and therefore chamber A can operate at a higher temperature than chamber B assuming the flow in the heating pipe is into reservoir A and then B.

I claim:

1. A thermosyphon radiator comprising a single sealed panel formed into two or more discrete chambers, each containing a discrete reservoir of vaporising liquid in a lowermost part of the panel, and each reservoir having its own inlet and outlet for a heating member extending through the lowermost part of the panel with clearance, the heating member being at least partially immersed in the vaporizing liquid.

2. A thermosphon radiator as claimed in claim 1 in which the liquid comprises either water, ammonia, methanol or acetone.

3. A thermosyphon radiator comprising a single sealed panel formed into two or more discrete chambers, each containing a discrete reservoir of water in a lowermost part of the panel and each reservoir having its own inlet and outlet for a heating member extending with clearance through the lowermost part of the panel.

4. A radiator as claimed in claim 1 in which the liquid is water.

5. A radiator as claimed in claim 1 in which the member is a pipe for carrying a second liquid.

6. A radiator as claimed in claim 5 in which the pipe is covered externally with a fine metallic mesh, compacted metallic wool, fibrous material or a polymeric coating.

7. A radiator as claimed in claim 5 in which the pipe is coated with a porous material.

8. A radiator as claimed in claim 1 or claim 2 in which the pipe is immersed in the vaporising liquid to a depth of no less than three-quarters of the diameter of the pipe.

9. A radiator as claimed in claim 3 in which the pipe is immersed in the water to a depth of no less than three-quarters of the diameter of the pipe.

10. A radiator as claimed in claim 1 in which the panel is of pressed steel or roll-bonded aluminium.

11. A radiator as claimed in claim 1 in which each reservoir is hermetically sealed.

12. A radiator as claimed in claim 1 in which each chamber is evacuated.

13. A radiator as claimed in claim 2 in which the water is distilled water.

14. A radiator as claimed in claim 1 in which the panel is externally finned.

* * * * *